United States Patent [19]

Kanno

[11] Patent Number: 4,822,307

[45] Date of Patent: Apr. 18, 1989

[54] WARNING DEVICE FOR A WATERCRAFT PROVIDED WITH A PLURALITY OF MARINE PROPULSION ENGINES

[75] Inventor: Isao Kanno, Hamamatsu, Japan

[73] Assignee: Sanshin Kogyo Kabushiki Kaisha, Hamamatsu, Japan

[21] Appl. No.: 36,019

[22] Filed: Apr. 8, 1987

[30] Foreign Application Priority Data

Apr. 8, 1986 [JP] Japan ..... 61-80870

[51] Int. Cl.[4] ..... F01B 21/00

[52] U.S. Cl. ..... 440/1; 440/2; 440/3; 440/53

[58] Field of Search ..... 114/144 R, 144 RE, 144 A, 114/162–164; 440/1–3, 40, 49, 51, 43, 53, 61, 63, 87; 340/984; 123/DIG. 8; 364/424, 431.01, 431.03; 244/53 R, 51, 62, 5.5; 60/698, 700–702, 705, 710, 712, 719

[56] References Cited

U.S. PATENT DOCUMENTS

| | | | |
|---|---|---|---|
| 3,174,284 | 3/1965 | McCarthy | 60/705 |
| 3,797,447 | 3/1974 | Stubblefield | 440/1 |
| 3,976,026 | 8/1976 | Eastling | 440/43 |
| 4,254,619 | 3/1981 | Giffin | 244/55 |
| 4,479,357 | 10/1984 | Stewart | 60/719 |
| 4,519,335 | 5/1985 | Krautkremer | 440/53 |
| 4,562,801 | 1/1986 | Yoike | 123/196 S |
| 4,649,708 | 3/1987 | Fisher | 60/719 |

FOREIGN PATENT DOCUMENTS

| | | | |
|---|---|---|---|
| 58-214494 | 12/1983 | Japan | 440/1 |

*Primary Examiner*—Sherman D. Basinger
*Assistant Examiner*—Clifford T. Bartz
*Attorney, Agent, or Firm*—Ernest A. Beutler

[57] ABSTRACT

A number of embodiments of warning devices for watercraft provided with a plurality of marine propulsion engines for providing an arrangement for avoiding course deviations in the event of an abnormal running condition of one of the engines which tends to cause a course deviation. In one embodiment, the course correction is provided by slowing of the normally running engine in the event of slowing of the abnormally running engine. In other embodiments, the course deviation is prevented by a steering device. In one embodiment, the steering device comprises means for steering of the normally running engine and in another embodiment, the steering device comprises a trim tab.

23 Claims, 7 Drawing Sheets

WARNING DEVICE FOR A WATERCRAFT PROVIDED WITH A PLURALITY OF MARINE PROPULSION ENGINES

BACKGROUND OF THE INVENTION

This invention relates to a warning device for a watercraft provided with a plurality of marine propulsion engines and more particularly to a device that prevents course deviations in the event of an abnormal condition of only one of the engines that tends to cause a course deviation.

It is well known to provide watercraft with a plurality of powering outboard drive units. These outboard drive units may comprise either outboard motors or the outboard drive portion of inboard-outboard drives. In connection with the use of such plural outboard drives, if some abnormal running condition of one of the outboard drives causes a sudden change in its speed, the continued operation of the other outboard drive at its normal speed will obviously cause a course deviation.

It is, therefore, a principal object of this invention to provide a device for a watercraft with a plurality of marine propulsion engines wherein course deviations are prevented if an abnormal condition exists in one of the engines that tends to cause a course deviation.

It is a further object of this invention to provide an improved system for warning of a condition which will tend to cause a course deviation.

SUMMARY OF THE INVENTION

A first feature of this invention is adapted to be embodied in a marine propulsion device for watercraft having a first engine driving first propulsion means and a second engine driving second propulsion means. Sensing means are incorporated for sensing an abnormal condition of either of the engines tending to cause a deviation in the course of the watercraft and means are responsive to the sensing of such an abnormal condition for initiating means for preventing course deviations due to the abnormal condition.

Another feature of the invention is adapted to be embodied in a warning system for a marine propulsion device which also comprises first and second engines driving respective first and second propulsion means. In accordance with this embodiment of the invention, each of the engines is provided with sensing means that sense an abnormal running condition of the respective engine that will tend to cause a course deviation and which gives a signal of such a condition. In accordance with this feature of the invention both of the warning means are activated regardless of which of the engines is encountering the abnormal condition tending to cause a course deviation.

DETAILED DESCRIPTION OF THE PREFERRED EMBODIMENTS

Figure 1:
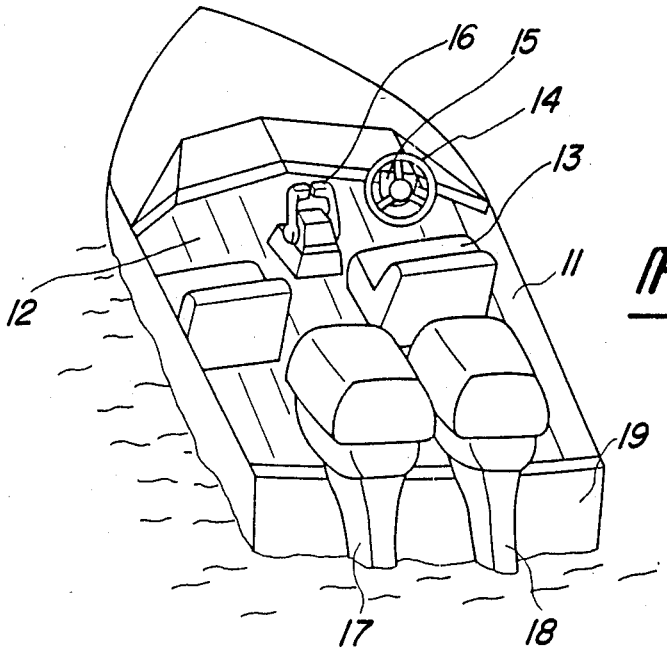
FIG. 1 is a perspective view of a watercraft powered by a pair of outboard motors and embodying a warning and course deviation preventing device constructed in accordance with an embodiment of the invention.

Referring first to FIG. 1, a watercraft that is adapted to employ a powering system embodying the invention is identified generally by the reference numeral 11. The watercraft 11 is comprised of a hull that defines a passenger compartment 12 in which a pair of seats including an operator's seat 13 are positioned. A steering wheel 14 and dashboard 15 are positioned to the front of the operator's seat 13. In addition, a combined throttle and transmission control mechanism 16 is positioned adjacent the operator's seat 13.

A pair of outboard motors 17 and 18 are mounted on a transom 19 of the hul1 11 for powering the watercraft. The outboard motors 17 and 18 are controlled by the dual handles of the control mechanism 16 in a known manner.

Each of the outboard motors 17 and 18 is provided with a warning system for providing a warning signal in the event of an abnormal running condition that tends to cause course deviations and for preventing such course deviations in the event of such an abnormal condition. These systems are shown schematically by the block diagram in FIG. 2 and, in accordance with the invention, an interrelationship is provided between the individual systems so that if either engine experiences such an abnormal running condition, both engine warnings will be activated and course deviations will be prevented.

Figure 2:
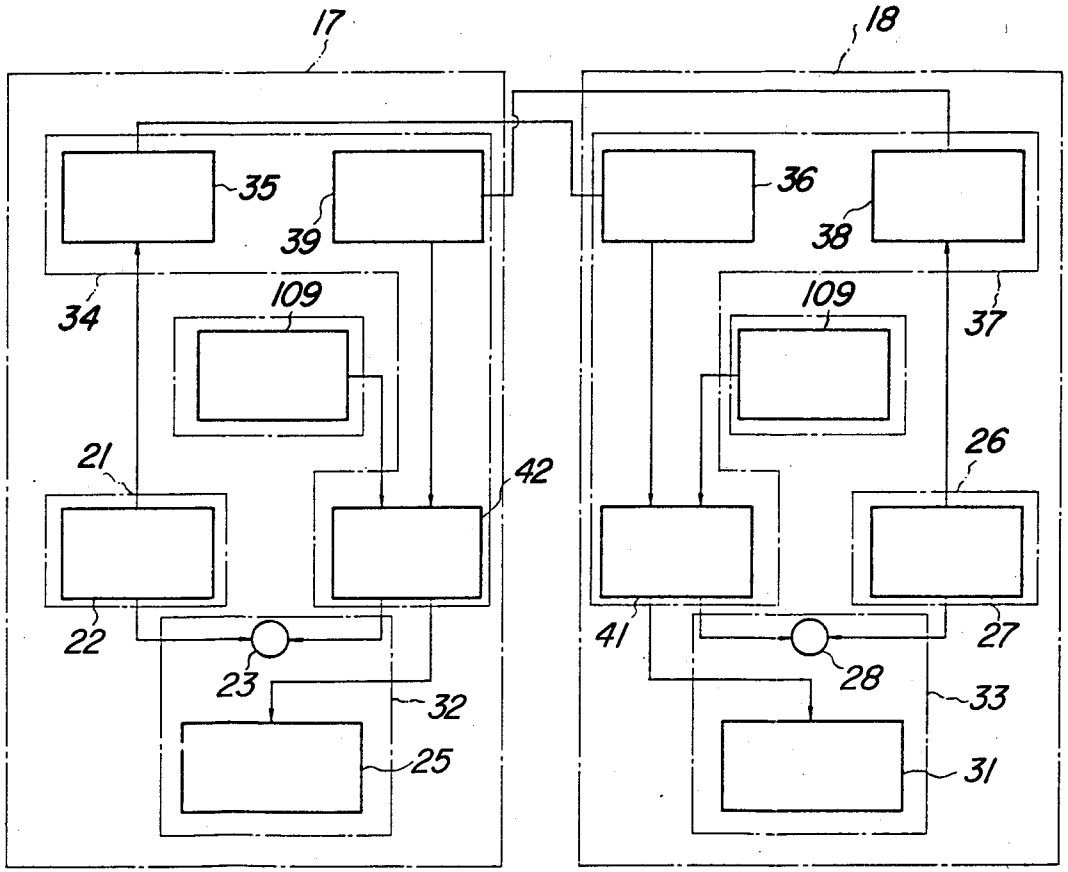
FIG. 2 is a schematic block diagram showing the warning and course deviation preventing mechanism of this embodiment.

Referring now specifically to FIG. 2, the sensing means of the outboard motor 17 is indicated generally by the block 21 and includes an abnormal speed sensor such as a sensor 22 that indicates reduced engine speed or stopping of the engine 17. In the event the speed sensor 22 senses a reduced engine speed, it will operate a warning buzzer 23. The warning buzzer 23 is positioned at or in proximity to the dash panel 15. Thus, the ooperator seated in the seat 13 will immediately receive a signal of an abnormal running condition of the outboard motor 17.

In a similar manner, the outboard motor 18 includes an abnormal speed sensor 26 that includes an abnormal speed sensing device 27, which also is responsive to the sensing of an abnormal engine speed. When the sensor 27 indicates an abnormal engine speed, it will activate a buzzer 28 so as to give the operator an indication of an abnormal running condition.

The warning and course deviation protection system of the engine 17 is indicated by the block 32 while the warning and course deviation protective system of the engine 18 is indicated by the block 33. The systems 32 and 33 are interrelated so that the activation of the warning system of either engine will result in the activation of the warning system of the other system. If, for example, the warning system 21 and specifically the abnormal speed condition sensor 22 outputs a warning signal, this warning signal is transferred by a control means, indicated by the block 34 and including a transfer circuit 35, to a warning signal receiving circuit 36 of the outboard motor 18. In a similar manner, the sensing circuit 26 and specifically the abnormal speed condition sensor 27 sends a signal through a control means 37 including a warning signal transfer circuit 38 to a receiving circuit 39 of the outboard motor 17.

The receiving circuit 36 of the outboard motor 18 outputs a signal to a holding circuit 41 which, in turn, activates the speed controlling circuit 31 of the outboard motor 18 so as to effect a reduction in its speed to avoid course deviations in the event of an abnormal condition of the motor 17 and also sound the warning buzzer 28. In a similar manner, the receiving circuit 39 of the outboard motor 17 transfers its signal to a holding circuit 42 that will activate the speed reducing circuit 25 of this motor so as to reduce its speed to avoid course deviation and sound the buzzer 23 in the event of an abnormal condition in the motor 18.

It should be readily apparent that the disclosed system insures that the operator will be adequately warned in response to the abnormal speed condition of either of the outboard motors 17 and 18 and, further, that both of the outboard motors 17 and 18 will be slowed in the event of an abnormal running condniton of either of them. Hence, a sudden directional change of the watercraft 11 will be averted.

An arrangement is provided for permitting the normal running engine to be operated at its maximum speed under operator control, even if the abnormal running engine does not have its abnormal situation corrected. However, it is also important to insure that correction of the condition of the abnormal running engine does not cause immediate resumption of the preset speed for the normal running engine because this could upset the occupants of the watercraft. Thus, in order to return the normal running engine to full operator control and regardless of whether or not the abnormal running engine has its situation corrected, certain things must be done by the oeprator in order to return the normal engine to full control. Protection may be accomplished by either requiring the operator to shift the normal running engine to its neutral condition or to manually close the throttle of the normal running engine to its idle condition. If any one of the aforenoted conditions are met (shifting to neutral or closing the throttle valve), the holding circuit of the normal running engine (41 or 42) is deactivated so that that engine can return to its normal running speed.

Figure 3:
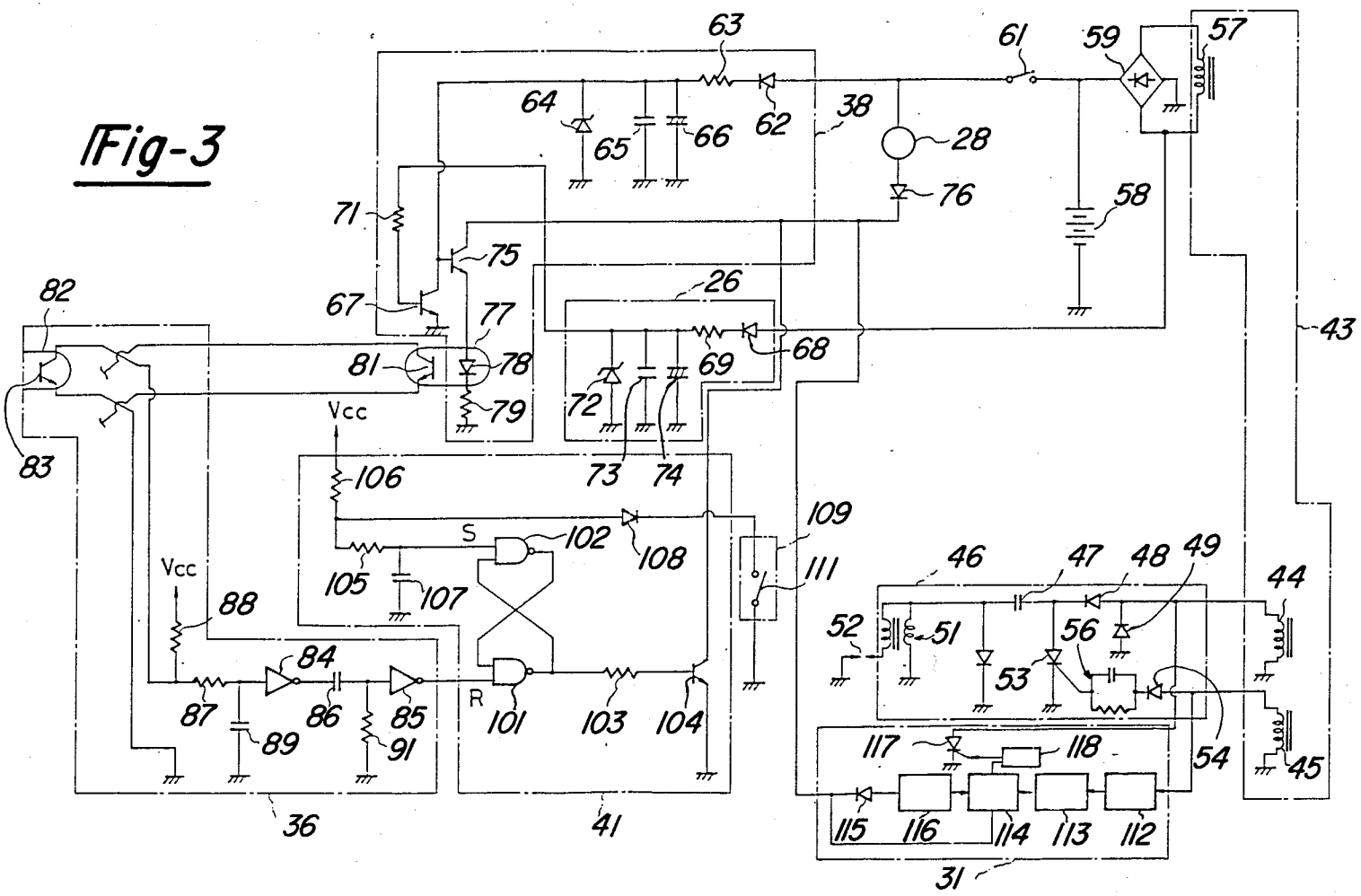
FIG. 3 is a schematic electrical diagram of the device associated with one engine.
Figure 4:
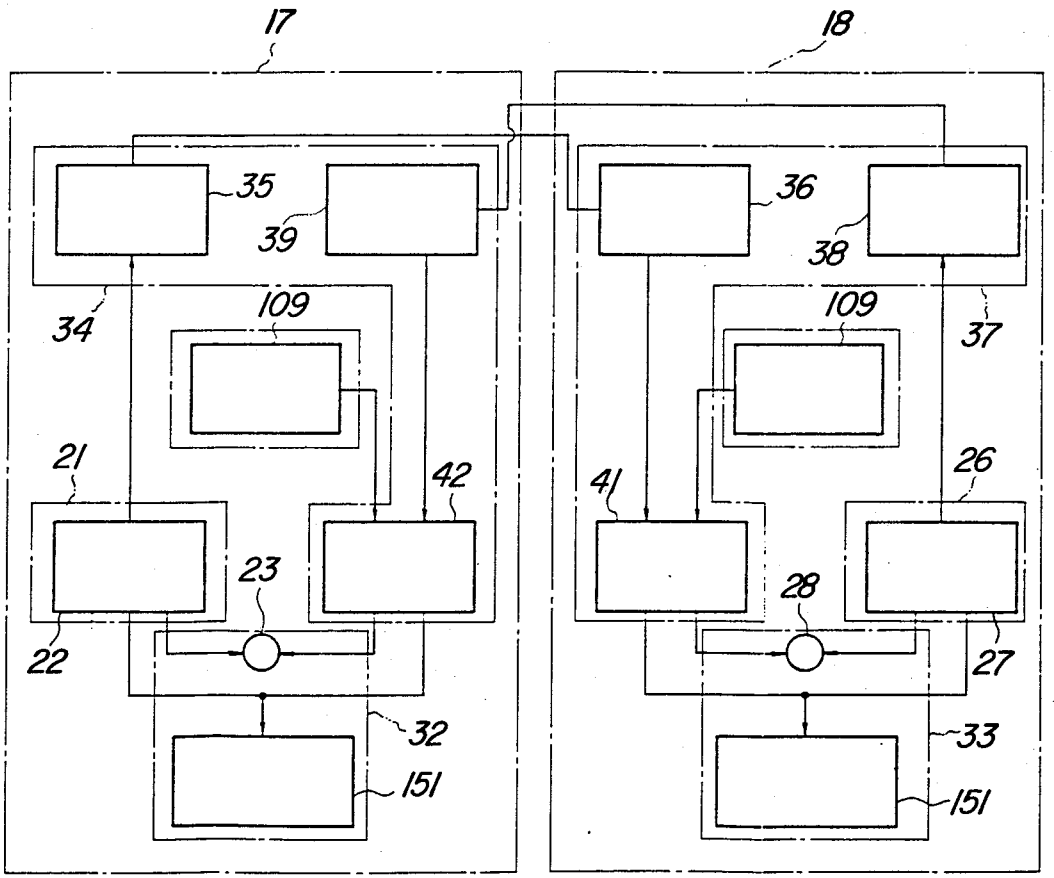
FIG. 4 is a schematic block diagram, in part similar to FIG. 2, showing a course deviation preventing device constructed in accordance with a second embodiment of the invention.

Referring now in detail to FIG. 3, the actual electrical circuit for the device is illustrated in conjunction with the outboard motor 18 and shows its relationship to the output signals which are sent to the holding circuit 42 of the outboard motor 17 and for receiving the signals from the transfer circuit 35 of the outboard motor 17.

In FIG. 3, a magneto generator is indicated generally by the reference numeral 43 and is associated, in a known manner, with the flywheel of the engine of the outboard motor 18. This magneto generator 43 includes a charging coil 44 and a pulser coil 45 that provide their charges and signals to a capacitor discharge ignition circuit, represented by te block 46 and having the circuit illustrated therein.

The capacitor discharge ignition circuit 46 includes a charging capacitor 47 that is charged by the charging coil 44 through a rectifying diode 48. A further diode 49, that conducts current in the opposite direction, is interposed in parallel relationship between the diode 48 and the charging coil 44. The diode 49 is connected between the ground and the charging coil 44 so as to provide a circuit during the half wave of operation when the capacitor 47 is not being charged.

The capacitor 47 is charged during one-half wave of the operation of the charging coil 44 and is discharged at an appropriate time, by means of a triggering cirucit, to be described, so as to cause a discharge through a primary winding of an ignition coil 51 so as to induce a voltage in the secondary coil that causes a spark plug 52 to be fired. It is to be understood that although only a single cylinder and spark plug is depicted, the system can readily be applied to multi-cylinder engines by those skilled in the art.

The triggering circuit for the charging capacitor 47 includes a SCR 53 that is in circuit between the diode 48 and charging capacitor 47 and the ground. The voltage of the gate of the SCR 53 is controlled by the pulser coil 45 which, in turn, has a current induced in it at the appropriate time of crankshaft angle by means of a trigger magnet (not shown). The voltage through a diode 54 and capacitor resistor circuit 56 renders the gate of the SCR 53 conductive so that the charging capacitor 47 will be discharged and the spark plug 52 fired at the apprioriate crankshaft angle.

The magneto generator 43 also includes a generating coil 57 that charges a battery 58 through a rectifier diode bridge 59. A main ignition switch 61 connects the battery 58 with a plurality of circuits including a stable voltage supply circuit consisting of a diode 62, resistor 63 and a suitably grounded zener diode 64, capacitor 65 and electrolytic capacitor 66 so as to provide a stable voltage supply to the collector of a transistor 67. The transistor 67 has its emitter connected to the ground so that when it becomes conductive, the circuit will be grounded.

The base of the transister 67 is switched on and off so as to render the transistor 67 either conductive or not in response to the speed of the engine. For this purpose, the generating coil 57 has an output circuit that is connected through a diode 68 and a pair of resistors 69 and 71 to the base of the transistor 67. A stabilizing circuit comprised of a grounded zener diode 72, capacitor 73 and electrolytic capacitor 74 are interposed between the resistors 69 and 71 so as to provide a filtering function in the voltage supply transmitted to the base of the transistor 67.

When the engine is running above a predetermined speed, the voltage potential at the base of the transistor 67 will be sufficient to keep the transistor 67 conductive and the circuit will be grounded. However, if the voltage drops due to a decrease in speed of the engine, the transistor 67 will no longer be conductive and the circuit will no longer be grounded. In this condition, a base of a transistor 75 will see a potential change which will switch it from a normally off condition to an on condition. When the transistor 75 becomes conductive, it will complete a circuit through the buzzer 28 and a rectifying diode 76 so as to sound the buzzer.

At the same time, a circuit will be completed through an optical isolator 77. The optical isolator 77 includes a light emitting diode (LED) 78 which is connected to ground through a resistor 79. Hence, when the transistor 75 is switched on, the light emitting diode 78 will also be switched on so as to emit light. The illumination of the LED 78 will cause a base of a transistor 81 to be activated so as to cause the transistor 81 to be conductive. This will cause a current to flow through the lines which lead to the warning receiving signal 39 of the outboard motor 17 so as to activate its holding circuit 42 so as to effect the warning indication and also so as to slow the speed of the engine of the outboard motor 17 in a manner to be described. This receiving and holding circuit is the same as the corresponding circuits 36 and 41 of the outboard motor 18 and these circuits may be understood by reference to FIG. 3.

Receiving circuit 36 of the outboard motor 18 includes an optical isolator 82 which is similar to the optical isolator 77 and which includes an LED (not shown) which switches on a transistor 83 so as to transmit a signal to a signal processing circuit that includes a pair of inverters 84 and 85 that are in series with a capacitor 86 positioned between them. A pull up resistor 87 is in this series circuit as is a further resistor 88 from a power source. A grounded capacitor 89 is interposed between the first inverter 84 and the ground and a resistor 91 is grounded between the other inverter 85 and capacitor 86.

The output of the receiver circuit 36 is transmitted to the holding circuit 41 including a flip-flop comprised of a pair of appropriately wired NAND gates 101 and 102. The NAND gate 101 is in circuit through a resistor 103 with the base of a transistor 104. The transistor 104 has its state changed so that the abnormal condition signal is transmitted to the circuit 31 so as to effect a speed reduction through the circuit 31 in a manner to be described and sounding of the buzzer 28 of the normally running engine.

The flip-flop circuit also includes a pair of resistors 105 and 106 and a capacitor 107. A diode 108 is positioned in a reset line that extends to a reset device 109 which may include a switch 111 that is responsive to shifting of the normally running outboard motor to its neutral condition or movement of its throttle to idle so as to reset the flip-flop and disengage the holding circuit so that the outboard motor 18 may again be returned to its normal running speed. Alternatively, the switch 111 may be operated in response to other conditions, as aforenoted.

It should be noted that a similar reset switch 111 is provided for the outboard motor 17 for permitting its holding circuit to be disabled when the abnormal condition exists in the outboard motor 18 and the motor 17 has been moved to its neutral position or has otherwise been stabilized.

As has been noted, when the transistor 104 has been rendered conductive, the buzzer 28 will be sounded. In addition, the speed of the normally running engine, this being the engine of the outboard motor 18 in the case the speed of the engine 17 slows abnormally, will be slowed by a speed reducing circuit 31. This speed reduction circuit operates as shown in the embodiment of FIG. 2 of U.S. Pat. No. 4,562,801, entitled "Engine Control System For Marine Prouplsion Device", issued Jan. 7, 1986 in the name of Takashi Koike, and asigned to the assignee of this application, and reference may be had to that patent for the details of the manner of speed reduction. Generally, however, the speed reducing circuit 31 includes a waveform shaping circuit 112 that receives signals from the pulser coil 45. The circuit 112 generates a square waveform pulse from these signals and transmits them to a frquency to voltage converter 113 which outputs a voltage signal indicative of engine speed to an oscillator circuit 114.

The abnormal engine speed signal transmitted to the transistor 83 also is transmitted through a diode 115 to a delay circuit 116. The delay circuit 116 has a voltage output that is delivered to the oscillator circuit 114. The delay circuit 116 operates like a capacitor in that its output signal decays along a curve.

The oscillator circuit 114 has its output voltage generated for a time period which is varied in accordance with the difference between the voltage from the frequency to voltage converter 113 and that from the delay circuit 116. This output voltage acts on a shunting circuit for shunting the output of the charging coil 44 to the ground through an SCR 117. The SCR 117 is rendered conductive by means of a gate circuit 118 controlled by the oscillator 114 so as to periodically disable the ignition of the engine and reduce its speed. This circuit is, as has been noted, described in more detail in U.S. Pat. No. 4,562,801 and reference may be had to that patent for the description of the logic and operation of the speed reducing circuit.

Thus, if one of the outboard motors 17 or 18 has an abnormal speed condition which is indicated by a slowing of its speed below the speed at which the transistor 67 is switched off, the speed of the other engine will be reduced correspondingly so as to avoid course variations. In addition, both engines warning buzzers will be sounded to indicate to the operator that there is such an abnormal condition of one of the outboard motors. In addition to the warning buzzer, a warning light may also be wired into the circuitry of FIG. 3 so as to provide an indication of the abnormal condition. Preferably, the light system will also be wired in such a way that both warning lights will be illuminated in the event of an abnormal condition of either engine.

Figure 5:
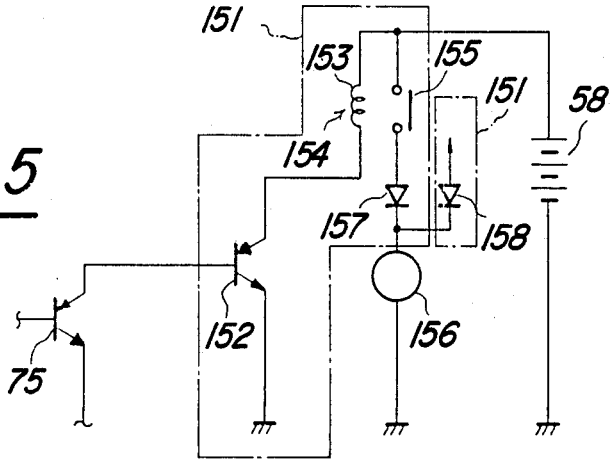
FIG. 5 is a partial schematic electrical diagram showing the device of this embodiment.

There are other ways of avoid course variations in response to an abnormal running condition of one of the outboard motors than by slowing the speed of the normally running outboard motor. FIGS. 4 through 9 show a still further embodiment of the invention for achieving this purpose. In this embodiment, the course variation is avoided in response to a slowing of one of the engines by steering of the outboard motors rather than by slowing of the speed of the normally running outboard motor. The basic control logic for this embodiment is substantially the same as that of the embodiment of FIGS. 1 through 3 and, for that reason, in the block diagram of FIG. 4, the components which perform the same general functions have been identified by the same reference numerals as the previously described embodiment. These similar components will not be described again in detail. In a similar manner, the basic control circuit is the same as the control circuit of FIG. 3 and, for that reason, the complete control circuit of this embodiment has not been illustrated. The only portion illustrated in FIG. 5 is the control circuit for achieving the steering of the outboard motors in response to the slowing of the engine speed.

In this embodiment, the steering construction replaces the engine speed slowing circuit of the previously described embodiment and will now be described by particular reference to FIG. 5. In this embodiment, each of the control circuits for the outboard motors 17 and 18 includes respective a steering circuit 151. The steering circuit associated with outboard motor 18 is depicted in FIG. 5 as aforenoted. The steering circuit 151 includes a transistor 152 that has its base in circuit with the emitter of the transistor 75. Hence, the transistor 152 will be switched in response to the condition of the transistor 75 so that the transistor 152 will be conductive when the transistor 75 is switched on by switching of the transistor 67 off. Alternatively, when the transistor 75 is switched off by switching of the transistor 67 on, the transistor 152 will be switched off. The transistor 152 controls the flow of current through a winding 153 of a relay 154. The winding 153, when energized, will close a normally open switch 155 of the relay 154. The switch 155 completes a circuit from the battery 58 through an electric motor 156 via a diode 157. It should be noted that there is also a similar circuit, indicated in phantom line and comprising a parallel circuit diode 158, associated with the corresponding circuit 151 of the outboard motor 17. Hence, if either of the outboard motors has an abnormal running speed (reduced below a predetermined value), the electric motor 157 will be actuated.

Figures 6, 11:
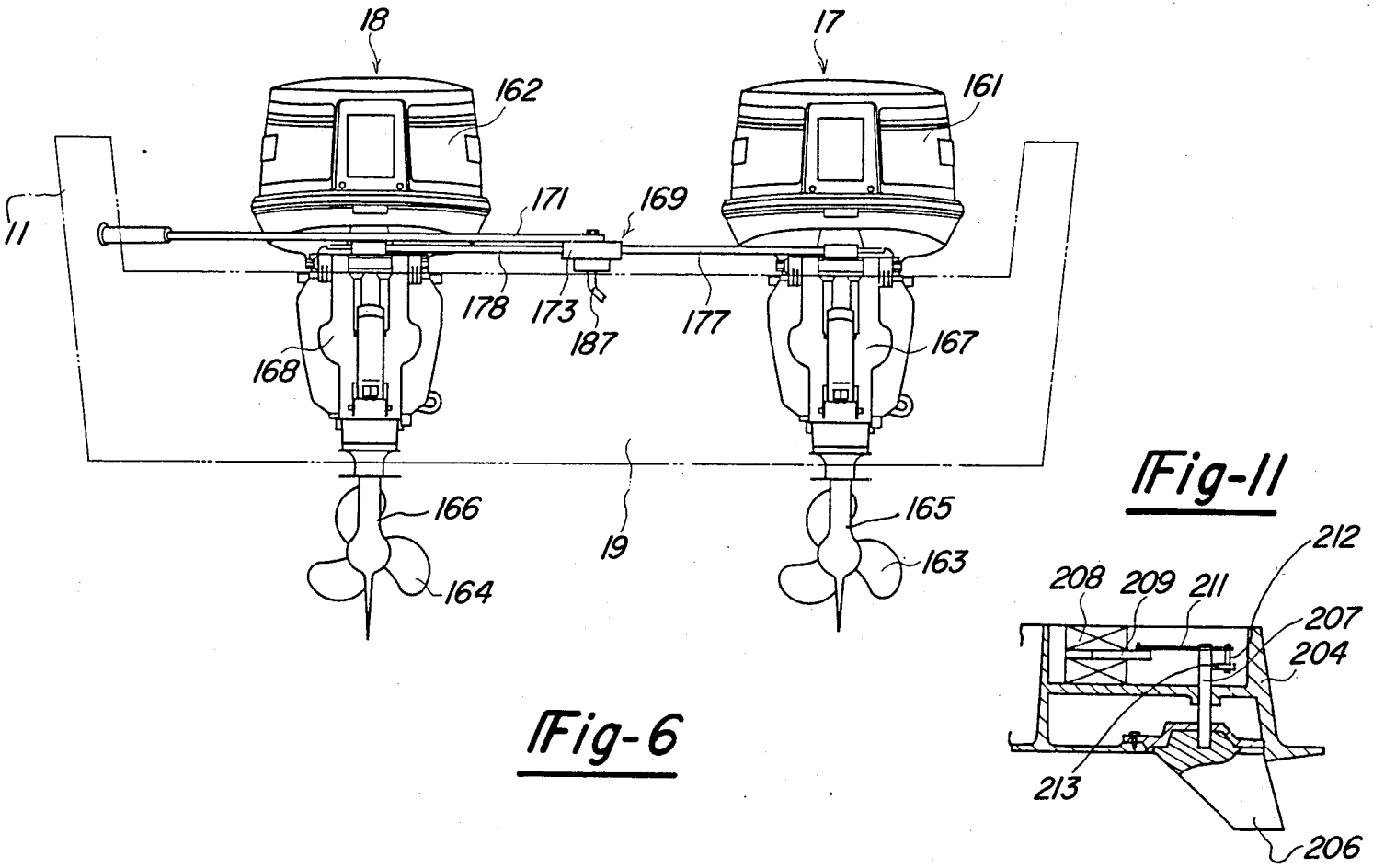
FIG. 6 is a front elevational view of the outboard motors and interconnecting arrangement in accordance with this embodiment.
FIG. 11 is an enlarged cross-sectional view of the course deviation preventing mechanism of this embodiment.

Referring now to FIG. 6, it will be noted that each of the outboard motors 17 and 18 includes a respective powerhead 161 and 162 in which a powering internal combustion engine is contained. The engines each drive respective drive shafts (in opposite directions as is normal with dual outboard motor practice) that are contained within respective drive shaft housings that depend from the power heads. These drive shafts each drive propellers 163 and 164 of lower units 165 and 166 that depend from the lower ends of the drive shaft housings.

The drive shaft housings are pivotally supported for steering movement by swivel brackets which are in turn pivotally connected about horizontally disposed pivot pins to clamping brackets 167 and 168, respectively, which are affixed in a known manner to the transom 19 of the watercraft 11.

As is normal practice, the outboard motors 17 and 18 are coupled together so that they will be steered simultaneously from the steering wheel 14. However, in this embodiment, this coupling is achieved by means including a fluid coupling device, indicated generally by the reference numeral 169 and shown in most detail in FIG. 7.

Referring now additionally to this figure, a steering link 171 which is actuated in a known manner from the steering wheel 13, is connected by means of a pivot pin 172 to a housing 173 of the fluid coupling device 169. As may be seen in FIG. 7, the housing 173 defines a cylinder bore 174 in which a pair of pistons 175 and 176 are slidably supported. The piston 175 has affixed to it a piston rod 177 that extends through one end of the housing 173 and which is suitably connected to the power head 161 of the outboard motor 17 for transmitting steering movement to it. In a like manner, a piston rod 178 is affixed to the piston 176 and extends through the other side of the housing 173 for coupling to the power head 162 of the outboard motor 18 for steering it.

Figure 7:
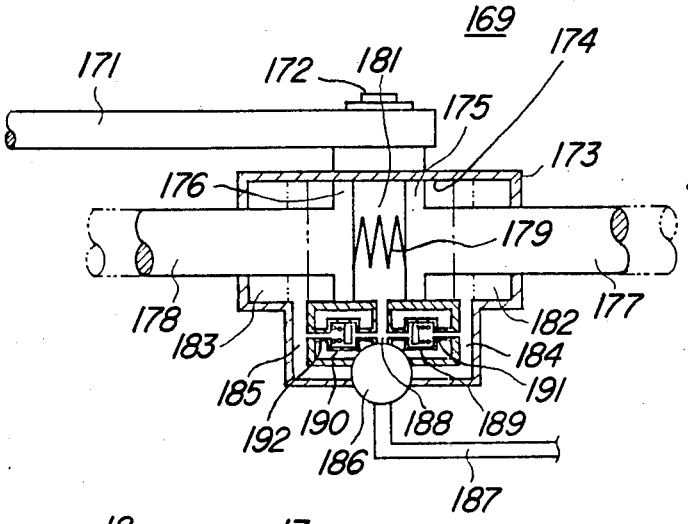
FIG. 7 is an enlarged view showing a portion of the mechanism with portions broken away.

A relatively stiff coil compression spring 179 is received within a chamber 181 formed between the pistons 175 and 176 and normally urges the pistons outwardly into an extended position as shown in the phantom line view of FIG. 7. The spring 179 has sufficient stiffness so that the device 169 normally acts as a rigid link so that the piston rods 177 and 178 will move together when the housing 173 is moved by the steering link 171 so that the outboard motors 17 and 18 will be steered simultaneously.

Figure 9:
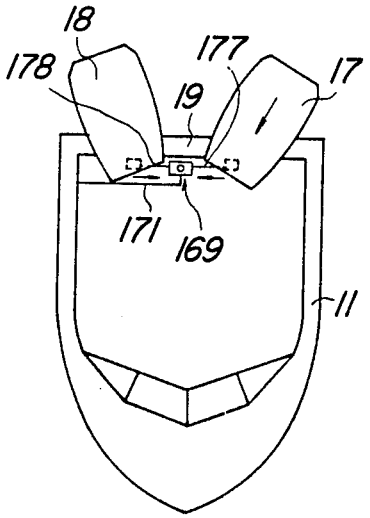
FIG. 9 is a top plan view, in part similar to FIG. 8, showing the device in the abnormal running condition.
Figure 10:
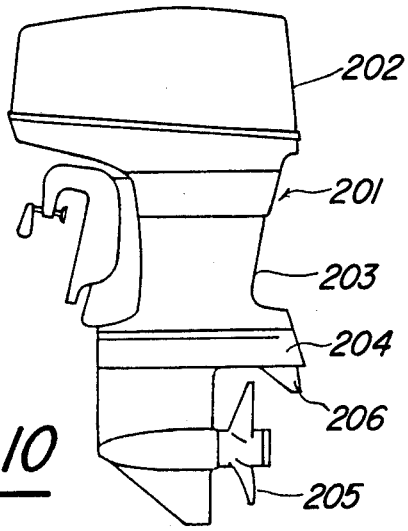
FIG. 10 is a side elevational view of an outboard motor constructed in accordance with yet another embodiment of the invention.

There are provided fluid chambers 182 and 183 on the piston rod sides of the pistons 175 and 176 within the housing 173. Fluid supply conduits 184 and 185 extend respectively from the discharge or pressure sides of a positive displacement fluid pump 186 to these chambers. The pump 186 is driven by the electric motor 156 of the circuit 151 as shown in FIG. 5 by means of electrical conductors 187. The pump 186 draws fluid from the chamber 181 through a supply passage 188 upon operation of the pump 186 so as to pressurize the lines 184 and 185 and the chambers 182 and 183 upon the sensing of an abnormal speed condition (slowing) of one of the outboard motors 17 and 18 through the circuitry as aforedescribed. When the chambers 182 and 183 are pressurized and the chamber 186 is depressurized, the pistons 175 and 176 will be urged inwardly to the solid line position as shown in FIG. 7 against the action of the spring 179. This will effect steering of the outboard motors 17 and 18 toward each other as shown in FIG. 9. In effect, this causes steering of the normally operating outboard motor in a direction so as to compensate for the slowing of the speed of the abnormally running outboard motor so that the watercraft 11 will be maintained on course as shown in FIG. 9. In this figure, it is asumed that the outboard motor 18 is the abnormally running outboard motor and it will be seen that the outboard motor 17 is steered so as to maintain a steady course for the watercraft 11 under this condition.

It should be noted that the pump 186 may be provided with an internal relief passage (not shown) so as to permit bypassing of the fluid when the pistons 175 and 176 are at their extreme inner conditions and wherein the pump 186 is continued to operate. This is a preferred mode of operation because it will insure that the normally operating outboard motor will be properly steered at all times when the abnormally running outboard motor has slowed so as to maintain the necessary course correction. Of course, it would be possible to provide an arrangement for stopping the pump 186 under this condition but the pump would have to be sealed so that leakage could not occur under the action of the spring 179 which would cause the pistons 175 and 176 to return to their normal positions.

Figure 8:
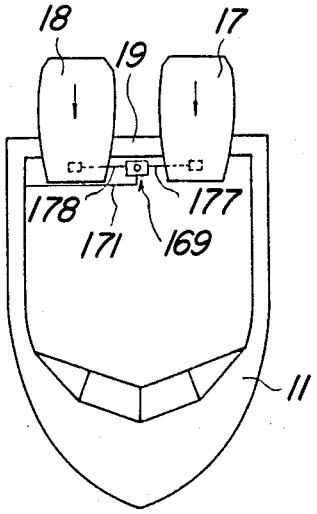
FIG. 8 is a top plan view showing the device of this embodiment under a normal condition.

When the abnormal running condition of the slowed outboard motor has been cured or when the system is reset by shifting of the transmission of the normal running outboard motor into neutral to close the reset switch 111, the pump 186 is stopped. Under this condition, normally opened check valves 188 and 189 formed in bypass passages 191 and 192, which have been closed by the pressure in the conduits 184 and 185 will be reopen and permit fluid to flow from the chambers 182 and 183 through the bypass passages 191 and 192 back to the chamber 181 under the action of the spring 179 so that the motors 17 and 18 are returned to their normal unsteered conditions relative to each other as shown in FIG. 8.

FIGS. 10 through 13 show a further embodiment of the invention wherein the course correction for an abnormal running condition of one of the outboard motors is achieved by means of a trim tab of the normal running outboard motor.

Figure 12:
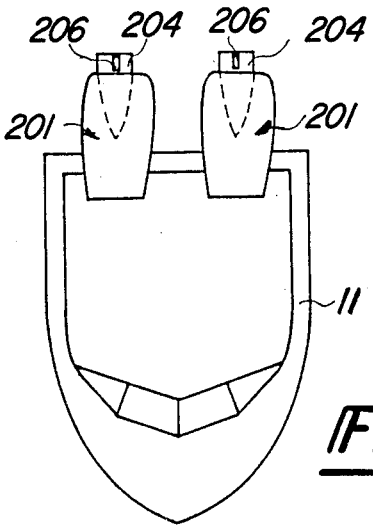
FIG. 12 is a top plan view of a watercraft constructed in accordance with this embodiment and operating in a normal condition.
Figure 13:
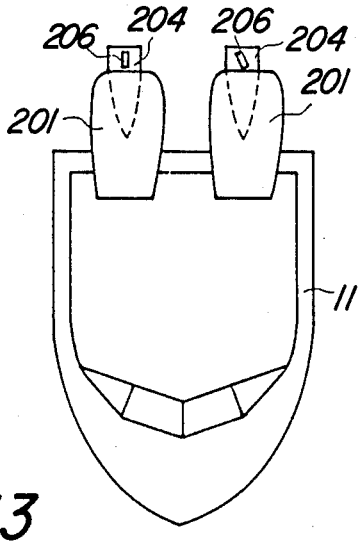
FIG. 13 is a top plan view, in part similar to FIG. 12, showing the abnormal running condition.

In this embodiment, each outboard motor is identified generally by the reference numeral 201 and includes a power head 202 having a powering internal combustion engine that drives a drive shaft (not shown) that is rotatably journaled in a drive shaft housing 203. A lower unit 204 positioned beneath the drive shaft housing 203 supports a propeller 205 that is driven by the drive shaft through a forward, neutral, reverse transmission of a known type. In accordance with this embodiment, the lower unit 204 rotatably journals a trim tab 206 (FIG. 11) by means including a pivot shaft 207. The pivot shaft 207 is affixed to the trim tab 206 and is journaled in any suitable manner in the lower unit 204. A solenoid motor 208 is contained within the lower unit 204 and drives an armature 209 that is connected to a link 211. The opposite end of the link 211 is pivotally connected by means of a pivot pin 212 to a lever 213 that is affixed to the shaft 207. The armature 209 is normally urged to an extended position as shown in FIG. 11 by means of a spring (not shown) so that the trim tab 206 will be in a normal straight position during normal running as shown in FIG. 12.

In this embodiment, the control circuit may comprise a control circuit substantially the same as that of the embodiment of FIGS. 4 through 9. However, in this embodiment, the electric motors 156 will be replaced by the solenoid 208 in the circuit of FIG. 5. Accordingly if one of the outboard motors has an abnormal running condition such as slowing below the predetermined value, the solenoid 208 of the normally running outboard motor will be activiated as shown in FIG. 12 so as to effect a course correction that will compensate for the slowed speed of the other outboard motor.

It should be readily apparent from the foregoing description that a number of embodiments of the invention have been illustrated and described. In each embodiment, in the event of an abnormal running condition of one of the outboard motors that will tend to cause a course deviation, the other outboard motor is activated in such a way as to correct for the course deviation and maintain the watercraft on course. In addition, a warning signal will be given to the operator of the watercraft so that the condition can be corrected. Although a number of embodiments of the invention have been illustrated and described, various changes and modifications may be made without departing from the spirit and scope of the invention, as defined by the appended claims.

I claim:

1. In a marine propulsion device for a watercraft having a first engine driving first propulsion means, a second engine driving a second propulsion means, sensing means for sensing an abnormal condition of either of said engines independently of the other engine condition tending to cause a substantial deviation in the course of said watercraft, and means responsive to the sensing of such an abnormal condition for initiating the operation of means for preventing course deviations due to said abnormal condition.

2. In a marine propulsion device as set forth in claim 1 wherein the means for preventing course deviations comprises means for effecting steering of the watercraft to compensate for the anticipated course deviation.

3. In a marine propulsion device as set forth in claim 2 wherein the means for effecting the steering consists of a trim tab.

4. In a marine propulsion device as set forth in claim 3 wherein there are trim tabs associated with each of the propulsion means and the activated trim tab comprises the trim tab of the normally operating engine.

5. In a marine propulsion device as set forth in claim 2 wherein the propulsion means are each supported for steering movement about respective vertically extending axes and the means for effecting steering comprises means for steering of the normally running propulsion means.

6. In a marine propulsion device as set forth in claim 5 wherein connecting means are provided for interconnecting the propulsion means for simultaneous steering movement about their respective vertically extending axes, the means for effecting steering comprises means for changing the effective length of said connecting means for pivoting said propulsion means relative to each other about their respective vertically extending axes.

7. In a marine propulsion device as set forth in claim 6 wherein the means for changing the effective length of the connecting means comprises a fluid actuated device.

8. In a marine propulsion device as set forth in claim 7 wherein the fluid actuated device comprises a fluid motor energized upon the sensing of the abnormal condition.

9. In a marine propulsion device as set forth in claim 1 wherein the abnormal running condition sensed is the falling of one of the engine speeds below a predetermined speed.

10. In a marine propulsion device as set forth in claim 9 wherein the means for preventing course deviation comprises means for slowing of the normally running engine.

11. In a marine propulsion device as set forth in claim 10 wherein the engines are spark ignited internal combustion engines and the means for slowing the normally running engine comprises means for interrupting its ignition system.

12. In a marine propulsion device as set forth in claim 9 wherein the means for preventing course deviation comprises means for steering the watercraft.

13. In a marine propulsion device as set forth in claim 12 wherein the means for steering consists of a trim tab.

14. In a marine propulsion device as set forth in claim 13 wherein there are trim tabs associated with each of the propulsion means and the activated trim tab comprises the trim tab of the normally operating engine.

15. In a marine propulsion device as set forth in claim 12 wherein the propulsion means are each supported for steering movement about respective vertically extending axes and the means for effecting steering comprises means for steering of the normally running propulsion means.

16. In a marine propulsion device as set forth in claim 15 wherein connecting means are provided for interconnecting the propulsion means for simultaneous steering movement about their respective vertically extending axes, the means for effecting steering comprises means for changing the effective length of said connecting means for pivoting said propulsion means relative to each other about their respective vertically extending axes.

17. In a marine propulsion device as set forth in claim 16 wherein the means for changing the effective length of the connecting means comprises a fluid actuated device.

18. In a marine propulsion device as set forth in claim 17 wherein the fluid actuated device comprises a fluid motor energized upon the sensing of the abnormal condition.

19. In a marine propulsion device as set forth in claim 15 wherein both of the propulsion means are steered.

20. In a marine propulsion device as set forth in claim 19 wherein the outboard drives are coupled by a coupling means for simultaneous steering movement and the means for steering the outboard motors in response to the abnormal running condition comprises means for effecting a change in the effective length of the coupling means.

21. In a marine propulsion device as set forth in claim 20 wherein the means for changing the effective length comprises a fluid operated connection.

22. In a marine propulsion device as set forth in claim 1 wherein each of the propulsion means is associated with a respective warning device for providing a warning to the operator in response to the abnormal condition and the means for preventing course deviations further includes means for activating both of the warning devices in the event of an abnormal running condition of either of the engines.

23. In a marine propulsion device for a watercraft having a first engine driving first propulsion means, a second engine driving second propulsion means, first sensing means for sensing an abnormal condition of said first engine independently of the condition of said second engine tending to cause a substantial deviation in the course of said watercraft, first warning means activated by said first sensing means for warning an operator of the abnormal condition, second sensing means for sensing an abnormal condition of said second engine independently of the condition of said first engine tending to cause a substantial deviation in the course of said watercraft, second warning means activated by said second sensing means, and means for activating both of said warning means upon the sensing of an abnormal condition by either of said sensing means.

* * * * *